US006319100B1

(12) United States Patent
Denda et al.

(10) Patent No.: US 6,319,100 B1
(45) Date of Patent: Nov. 20, 2001

(54) DISK EDGE POLISHING MACHINE AND DISK EDGE POLISHING SYSTEM

(75) Inventors: Yasuhide Denda; Satoru Kitta; Kiyokazu Gonda; Yoshio Nakamura; Yoshio Otsuka; Toshiaki Seki; Takuya Kakegawa; Atsushi Kajikura, all of Nagano (JP)

(73) Assignee: Fujikoshi Kikai Kogyo Kabushiki Kaisha, Nagano (JP)

( * ) Notice: Subject to any disclaimer, the term of this patent is extended or adjusted under 35 U.S.C. 154(b) by 0 days.

(21) Appl. No.: 09/565,668

(22) Filed: May 5, 2000

(30) Foreign Application Priority Data

May 13, 1999 (JP) ..... 11-132711

(51) Int. Cl.[7] ..... B24B 9/06

(52) U.S. Cl. ..... 451/65; 451/44; 451/178; 451/246

(58) Field of Search ..... 451/44, 57, 65, 451/178, 182, 246, 258

(56) References Cited

U.S. PATENT DOCUMENTS 5,404,678 * 4/1995 Hasegawa et al. ..... 451/180
5,514,025 * 5/1996 Hasegawa et al. ..... 451/44
5,609,514 * 3/1997 Yasunaga et al. ..... 451/65
5,738,563 * 4/1998 Shibata ..... 451/5

FOREIGN PATENT DOCUMENTS

11066552 * 3/1999 (JP) ..... G11B/5/82

* cited by examiner

*Primary Examiner*—Joseph J. Hail, III
*Assistant Examiner*—David B. Thomas
(74) *Attorney, Agent, or Firm*—Jordan and Hamburg LLP

(57) ABSTRACT

The disk edge polishing machine is capable of polishing an inner edge of a center hole of a disk and an outer edge thereof. In the disk edge polishing machine, a sucking member has a cylindrical end section. The sucking member sucks the disk by the cylindrical end section and exposes the inner edge and the outer edge of the disk. The sucking member spins together with the disk. An outer polishing member polishes the outer edge of the disk. An inner polishing member is inserted into the center hole and simultaneously polishes the inner edge of the disk. A first driving mechanism relatively moves the outer polishing member and the sucking member close to and away from the outer edge of the disk along a predetermined course. A second driving mechanism relatively moves the inner polishing member and the sucking member close to and away from the inner edge of the disk along another predetermined course extended from the predetermined course.

15 Claims, 8 Drawing Sheets

DISK EDGE POLISHING MACHINE AND DISK EDGE POLISHING SYSTEM

BACKGROUND OF THE INVENTION

The present invention relates to a disk edge polishing machine and a disk edge polishing system, more precisely relates to a disk edge polishing machine, which is capable of polishing an inner edge of a center hole of a disk and an outer edge thereof, and a disk edge polishing system including the disk edge polishing machines.

Glass disks are now used for manufacturing hard disks, laser disks, magnetic disks, etc. Inner edges and outer edges of glass disks must be beveled (rounded) and polished.

Conventionally, high polishing accuracy was not required but, these days, high polishing accuracy is required so as to make memory density higher. If the polishing accuracy is low, glassy dusts are scattered from the edges of the glass disks and badly influence functions of the glass disks, etc. Therefore, the edges of the glass disks must be polished like mirror faces with higher polishing accuracy.

Conventionally, the edges of the glass disks are polished, by a brush, to polish the edges of the glass disks. For example, the conventional method of polishing the edges of the glass disks are executed by the steps of: piling and holding the glass disks, e.g., 100 disks; supplying slurry (liquid abrasive agent including abrasive powder of ceria) to the brush; and rotating or reciprocally moving the brush so as to polish the edges of the glass disks.

However, in the conventional method, polishing speed is very low because of polishing many piled glasses by the brush. And the inner edges and the outer edges are polished by the brush, so polishing time must be longer. Further, it was impossible to polish with the required polishing accuracy (flatness or roughness).

SUMMARY OF THE INVENTION

An object of the present invention is to provide a disk edge polishing machine capable of polishing the edges of the glass disks with higher polishing accuracy.

Another object of the present invention is to provide a disk edge polishing system capable of efficiently polishing the edges of the glass disks with higher polishing accuracy.

To achieve the objects, the present invention has following structures.

The disk edge polishing machine, which polishes an inner edge of a center hole of a disk and an outer edge thereof, comprises:

- a sucking member having a cylindrical end section, the sucking member sucking the disk by the cylindrical end section and exposing the inner edge and the outer edge of the disk, the sucking member spinning together with the disk;
- an outer polishing member polishing the outer edge of the disk;
- an inner polishing member being inserted into the center hole and simultaneously polishing the inner edge of the disk;
- a first driving mechanism relatively moving the outer polishing member and the sucking member close to and away from the outer edge of the disk along a predetermined course; and
- a second driving mechanism relatively moving the inner polishing member and the sucking member close to and away from the inner edge of the disk along another predetermined course extended from the predetermined course.

In the disk edge polishing machine of the present invention, the outer polishing member and the inner polishing member can be smoothly relatively moved to and away from the disk, so that the inner edge and the outer edge can be simultaneously polished with higher polishing accuracy. By simultaneously polishing the both edges, polishing efficiency can be higher and required time to polish the disk can be shorter.

In the disk edge polishing machine, an inner circumferential face of the outer polishing member may contact the outer edge of the disk, and the outer polishing member may be spun so as to polish the outer edge of the disk. With this structure, contact area between the outer polishing member and the outer edge of the disk can be broader, so that the outer edge can be stably polished with high polishing accuracy and the polishing efficiency can be improved.

In the disk edge polishing machine, the outer polishing member may be spun about a fixed shaft, which is not relatively moved with respect to a base. With this structure, the outer polishing member, which is relatively large, is not moved except spinning, so the polishing work can be executed stably.

In the disk edge polishing machine, the predetermined courses may be arc courses rounding a coaxial center. With this structure, the moving courses of the outer polishing member and the inner polishing member can be easily set on the same line.

In the disk edge polishing machine, the first driving mechanism may include:

- a first arm having a first end, to which the sucking member is rotatably attached, and a second end, which is capable of pivoting about the coaxial center so as to move the sucking member on the arc course; and
- a first arm driving unit for turning the first arm, and the second driving mechanism may include:
  - a second arm having a first end, to which the inner polishing member is rotatably attached, and a second end, which is capable of pivoting about the coaxial center so as to move the inner polishing member on the arc course; and
  - a second arm driving unit for turning the second arm.

With this structure, the driving mechanisms, which are capable of precisely moving, can be simplified. Therefore, the polishing accuracy can be improved, and manufacturing cost of the machine can be reduced.

In the disk edge polishing machine, the predetermined courses are linear courses. With this structure, the outer edge of the disk can be always moved, with respect to the outer polishing member, with fixed angle, and the inner edge of the disk can be always moved, with respect to the inner polishing member, with fixed angle, so that the edges can be polished stably.

In the disk edge polishing machine, the first driving mechanism and the second driving mechanism may be air cylinder units. With this structure, the edges can be pressed onto the polishing members with proper controlled forces, so that the edges can be properly polished.

In the disk edge polishing machine, the outer polishing member and the inner polishing member may be mainly made of urethane foam. With this structure, the polishing members are inexpensive and can be exchanged easily.

In the disk edge polishing machine, a plurality of ring grooves may be formed in the inner circumferential face of the outer polishing member and arranged, in the axial direction of the outer polishing member, with regular separations, and a plurality of ring grooves are formed in the outer circumferential face of the inner polishing member and arranged, in the axial direction of the inner polishing member, with regular separations. With this structure, the edges of the disk, which have been beveled, can be properly polished like a mirror face.

In the disk edge polishing machine may further comprise:

an outer slurry path supplying slurry to a portion in which the outer polishing member contacts the outer edge of the disk; and an inner slurry path being communicated to an inner space of the sucking member, the inner slurry path supplying slurry to a portion in which the inner polishing member contacts the inner edge of the disk. With this structure, the slurry can be properly supplied to the portions, so that the edges can be properly polished.

Next, the disk edge polishing system of the present invention has following structures.

The disk edge polishing system comprises:

a couple of polishing stages, each of which has a disk edge polishing machine, which polishes an inner edge of a center hole of a disk and an outer edge thereof, including:

a sucking member having a cylindrical end section, the sucking member sucking the disk by the cylindrical end section and exposing the inner edge and the outer edge of the disk, the sucking member spinning together with the disk;

an outer polishing member polishing the outer edge of the disk;

an inner polishing member being inserted into the center hole and simultaneously polishing the inner edge of the disk;

a first driving mechanism relatively moving the outer polishing member and the sucking member close to and away from the outer edge of the disk along a predetermined course; and a second driving mechanism relatively moving the inner polishing member and the sucking member close to and away from the inner edge of the disk along another predetermined course extended from the predetermined course; and a disk handling machine feeding the disk to and receiving the disk from the sucking members of the polishing stages.

In the disk edge polishing system of the present invention, the disk can be fed to or received from one of the polishing stages while another disk is polished in the other polishing stage. Therefore, the disks are fed to or received from one of the polishing stages alternately, so that the disks can be efficiently fed to or received from the polishing stages. Namely, the edges of the disks can be efficiently polished, with high polishing accuracy, without complicating the system.

The disk edge polishing system may further comprise a cleansing stage being located between the polishing stages, the cleansing stage cleansing the disks, which are alternately conveyed from the polishing stages. The disks polished in the both polishing stages can be cleansed in one cleansing stage, so that the system can be simplified.

In the disk edge polishing system, centers of the polishing stages and the cleansing stage may be linearly arranged along a standard line, and the cleansing stage may be located at a center between the polishing stages. With this structure, the disks can be conveyed among the stages efficiently.

In the disk edge polishing system, the disk handling machine may have a chucking unit for holding the disk, and the chucking unit may be moved, in parallel to the standard line, by a driving unit. With this structure, the chucking unit can be efficiently moved among the stages, so that the disks can be efficiently fed and received.

In the disk edge polishing system, the sucking members may be reciprocally moved, between the polishing stages and the cleansing stage, by a reciprocating unit. With this structure, the disks can be securely held while the disks are polished and cleansed, and they can be fed and received efficiently.

BRIEF DESCRIPTION OF THEIR DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

A first embodiment of the disk edge polishing machine of the present invention will be explained with reference to FIGS. 1–8.

Figure 1:
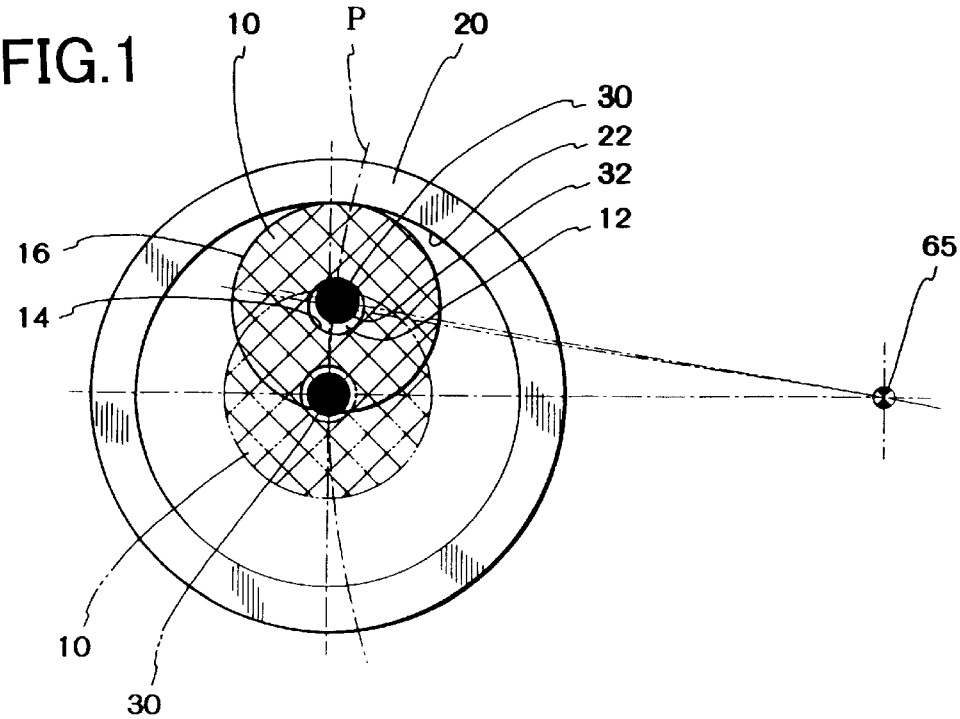
FIG. 1 is a plan view of a first embodiment of the disk edge polishing machine of the present invention.

In FIG. 1, a glass disk 10 has a center hole 12, an inner edge 14 and an outer edge 16.

The disk 10 is used as a substrate of a hard disk for a memory unit of a personal computer. For example, an outer diameter of the disk 10 is 95 mm; an inner diameter of the center hole 12 is 25 mm; a thickness of the disk 10 is 0.9 mm; and beveling angles of the edges 14 and 16 are 90°.

In FIG. 1, crossing lines are drawn in the disk 10 so as to clearly show the disk 10. Of course, no lines are actually formed on the surface of the disk 10, and the surface of the disk 10 is made highly flat. In FIG. 1, the disk 10 located at an initial position, at which the disk 10 is located immediately before and after polishing, is shown by a two-dot chain line.

An outer polishing member 20 is spun about its own axis so as to polish the outer edge 16 of the disk 10 by an inner circumferential face 22. In the first embodiment, the outer polishing member 20 is formed into a circular cylindrical shape and has the inner circumferential face 22. The outer polishing member 20 is spun by rotary means 24.

The outer polishing member 20 is spun about a fixed shaft 42, which is not relatively moved with respect to a base 40. With this structure, the outer polishing member 20, which is relatively large, is not moved except spinning, so that the polishing work can be stably executed.

An inner polishing member 30 is inserted in the center hole 12 of the disk 10. An outer circumferential face of the inner polishing member 30 contacts the inner edge 14 of the disk 10, and the inner polishing member 30 is spun so as to polish the inner edge 14. The outer edge 16 and the inner edge 14 of the disk 10 can be polished simultaneously. Note that, in FIG. 1, the inner polishing member 30 polishing and the inner polishing member 30 located at an initial position, at which the inner polishing member 30 is located immediately before and after polishing, are shown by black circles.

As clearly shown, the inner polishing member 30 is formed into a columnar shape and has the outer circumferential face 32. The inner polishing member 30 is spun, about its own axis, by rotary means 34.

To make the outer edge 16 of the disk 10 contact the inner circumferential face 22 of the outer polishing member 20, the disk 10 is moved close to and away from the outer polishing member 20, by a sucking member 50 and a first driving mechanism 60, along a predetermined course "P". In the present embodiment, the course "P" is an arc course. Simultaneously, the outer polishing member is moved, by a second driving mechanism 70, so as to make the outer circumferential face 32 of the inner polishing member 30 contact the inner edge 14 of the disk 10, along another predetermined arc course, which corresponds to an arc line extended from the course "P". Namely, the predetermined courses correspond to the arc "P" having radius "R" from a center 65. A center of the disk 10 and a center of the inner polishing member 30 are moved along the arc "P".

With this structure, the outer edge 16 and the inner edge 14 of the disk 10 can be simultaneously polished by properly moving the disk 10 and the inner polishing member 30.

Since the disk 10 and the inner polishing member 30 are moved on the same course "P", the inner polishing member 30 can be smoothly moved in the center hole 12 of the disk 10, so that the outer circumferential face 32 of the inner polishing member 30 can properly contact the inner edge 14 of the disk 10. When the edges 14 and 16 of the disk 10 is polished, a direction of pressing force working to the edges 14 and 16 and a direction of the counter force of the pressing force are on the same line. Thus, forces, which work to the first and the second driving mechanisms 60 and 70, always work in the same line, so that vibration of the machine can be prevented. By preventing the vibration, the edges 14 and 16 can be polished with higher polishing accuracy.

In the present embodiment, the direction of pressing the outer edge 16 of the disk 10 onto the inner circumferential face 22 of the outer polishing member 20 is equal to the direction of pressing the outer circumferential face 32 of the inner polishing member 30 onto the inner edge 14 of the disk 10. Therefore, the pressing force for pressing the disk onto the inner circumferential face 22 of the outer polishing member 20 is the sum of a force for moving the disk 10 by the sucking member 50 and a force for moving the inner polishing member 30.

Contact area between the outer edge 16 of the disk 10 and the inner circumferential face 22 of the outer polishing member 20 is apt to be broader than contact area between the outer circumferential face 32 of the inner polishing member 30 and the inner edge 14 of the disk 10 when the machine polishes the edges 14 and 16 uniformly. Thus, the force pressing the outer edge 16 of the disk 10 onto the inner circumferential face 22 of the outer polishing member 20 may be greater than the force pressing the outer circumferential face 32 of the inner polishing member 30 onto the inner edge 14 of the disk 10. Therefore, output forces of the first and the second driving mechanisms 60 and 70 can be easily designed, the structure of the machine can be simplified and manufacturing cost of the machine can be reduced.

Concrete examples of mechanisms of the disk edge polishing machine will be explained with reference to FIGS. 2–8. Note that, FIG. 2 shows an embodiment of the disk edge polishing system including the disk edge polishing machines of the first embodiment.

Figure 4:
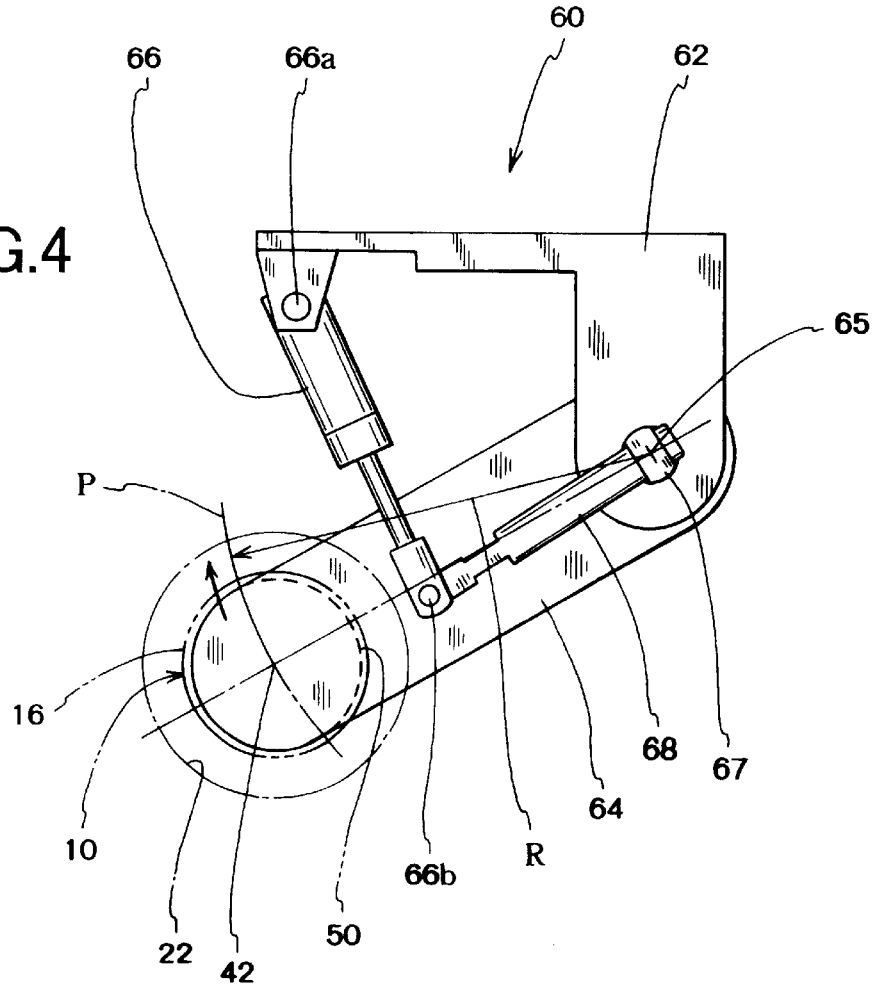
FIG. 4 is a plan view of a first driving mechanism shown in FIG. 3.
Figure 5:
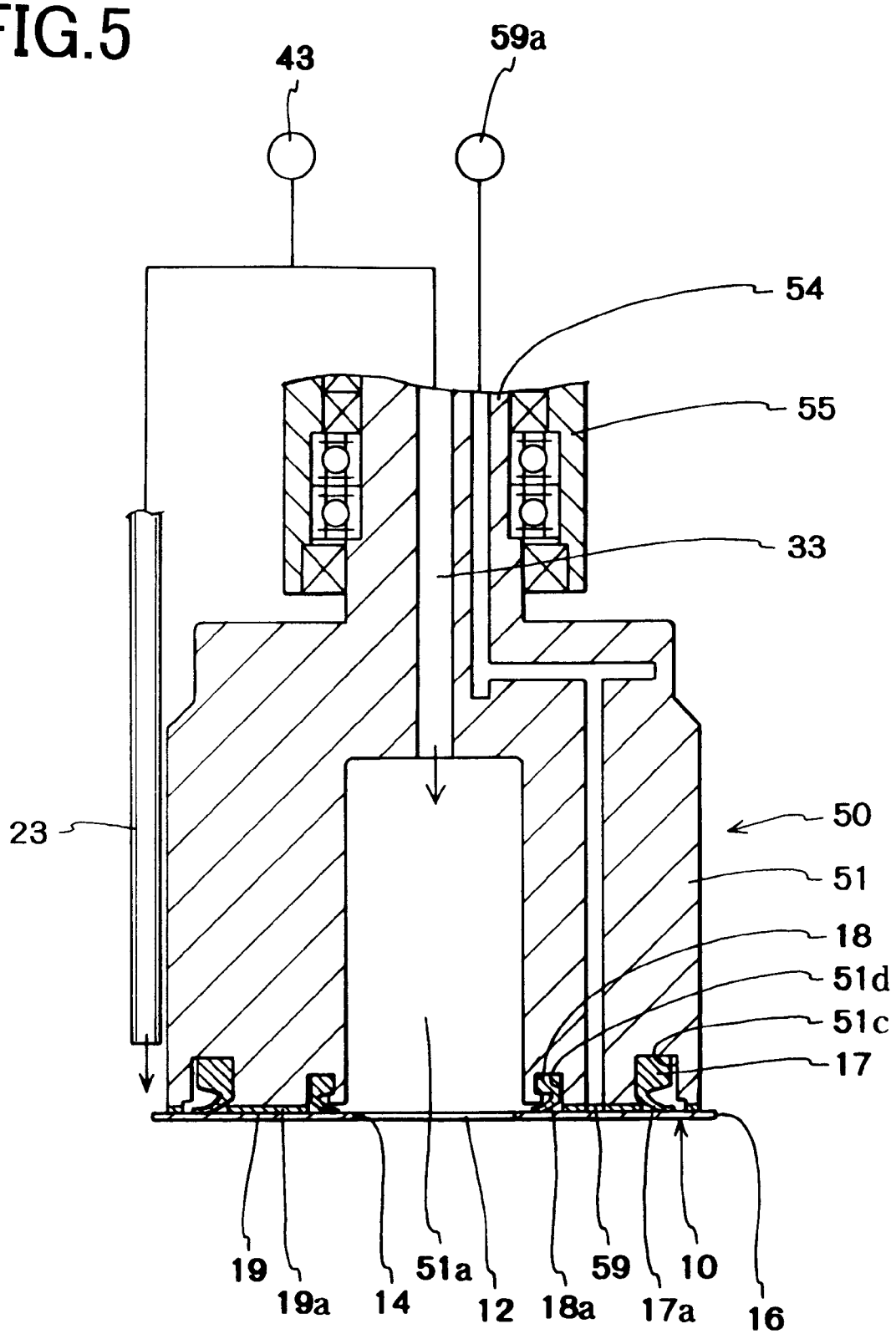
FIG. 5 is a sectional view of a sucking member for holding the disk.

As shown in FIGS. 2–5 and 8, especially clearly shown in FIG. 5, the sucking member 50 has a cylindrical end section and sucks the disk 10 by the cylindrical end section. When the sucking member 50 holds the disk 10, the inner edge 14 and the outer edge 16 of the disk 10 are exposed. The sucking member 50 is capable of spinning together with the disk 10.

Rotary means 52 (see FIG. 8) includes a motor 53, which is provided on a first arm 64, and a reduction gear unit (not shown) so as to spin the sucking member 50 and the disk 10. A rotary shaft 54 is rotatably held by a cylindrical bearing section 55, which is fixed to the first arm 64 and headed downward, and the rotary shaft 54 is rotated by the motor 53 with the reduction gear unit (see FIGS. 3, 5 and 8). With this structure, the sucking member 50, which is fixed to a lower end of the rotary shaft 54, can be spun.

Figure 2:
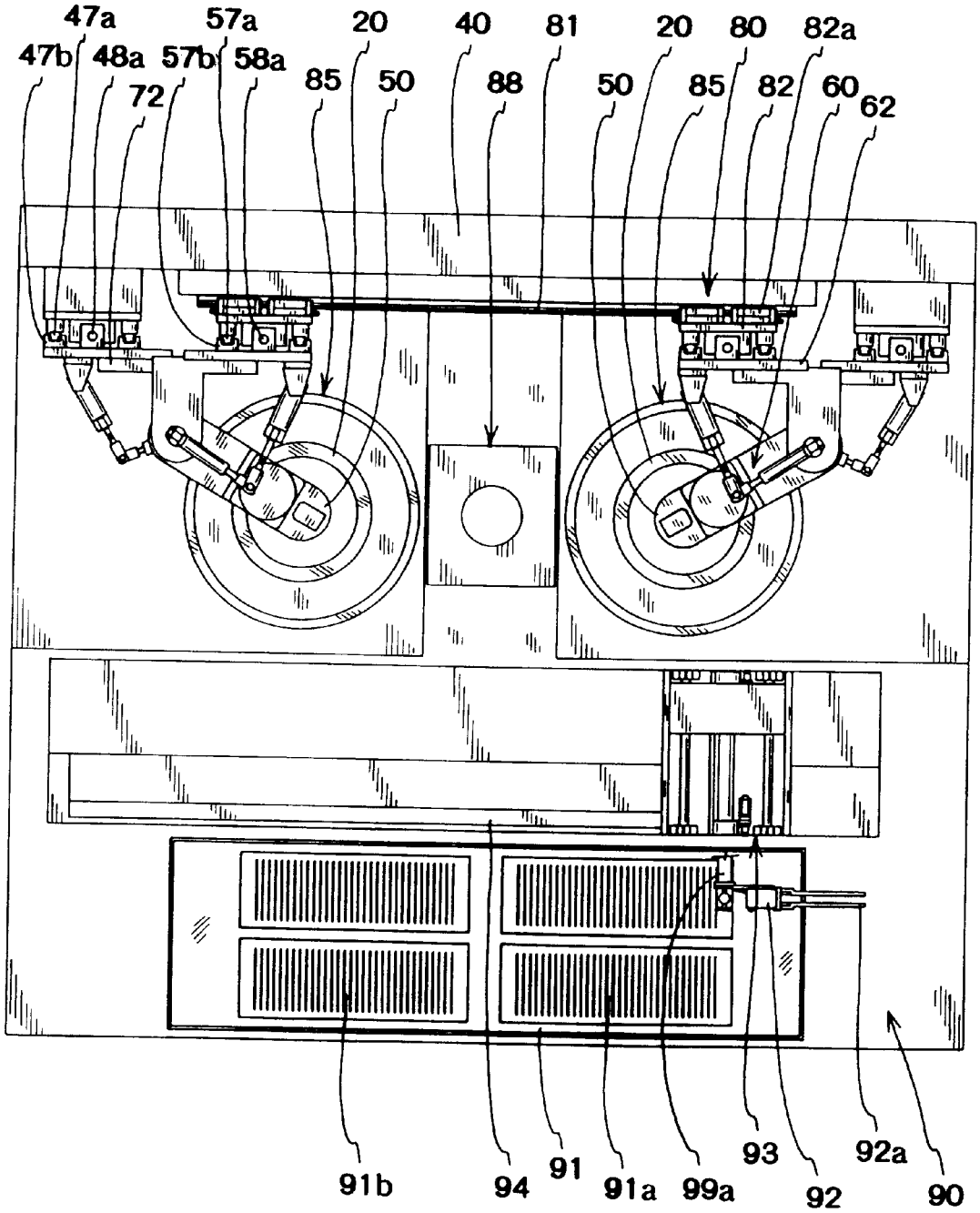
FIG. 2 is a plan view of an embodiment of the disk edge polishing system including the machines shown in FIG. 1.
Figure 3:
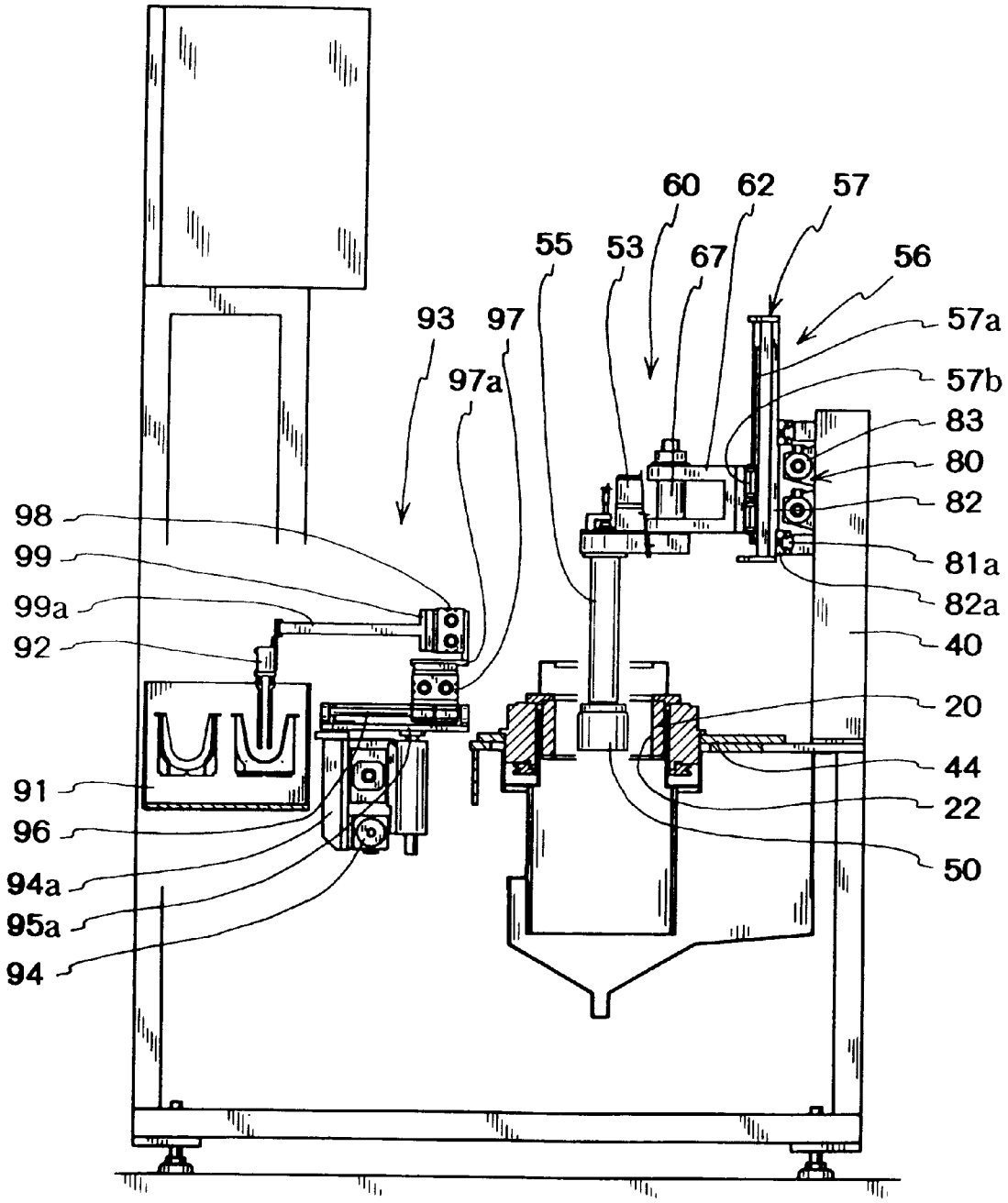
FIG. 3 is a side sectional view of a polishing machine, which polishes an outer edge of a disk, shown in FIG. 2.

The first driving mechanism 60 moves the sucking member 50 close to and away from the outer polishing member 22 along the predetermined course so as to make the outer edge 16 of the disk 10 contact the inner circumferential face 22 of the outer polishing member 20 (see FIGS. 2–4).

As shown in FIG. 4, the first driving mechanism 60 has the first arm 64, which is pivotatably attached to a first base section 62, and a first cylinder unit 66.

The sucking member 50 is rotatably attached to one end of the first arm 64. The other end of the first arm 64 is pivotably attached to the first base section 62 and can be rotated about a shaft 65. With this structure, the sucking member 50 can be moved along the arc course "P".

An end **66*a* of the first cylinder unit 66 is pivotably connected to the first base section 62. The other end 66*b* is pivotably connected to a front end of a first lever 68, which is fixed to a first shaft member 67. With this structure, the first cylinder unit 66 rotates the first arm 64** as a first arm driving unit.

By driving the first cylinder unit 66, the disk 10, which is held by the sucking member 50 and shown by the two-dot chain line, can be moved along the arc course "P", so that the disk 10 can be moved close to and away from the inner circumferential face 22 of the outer polishing member 20, which is shown by one-dot chain line. Note that, in the present embodiment, the outer edge 16 of the disk 10 can be made contact the inner circumferential face 22 of the outer polishing member 20 by retracting the first cylinder unit 66.

Figure 6:
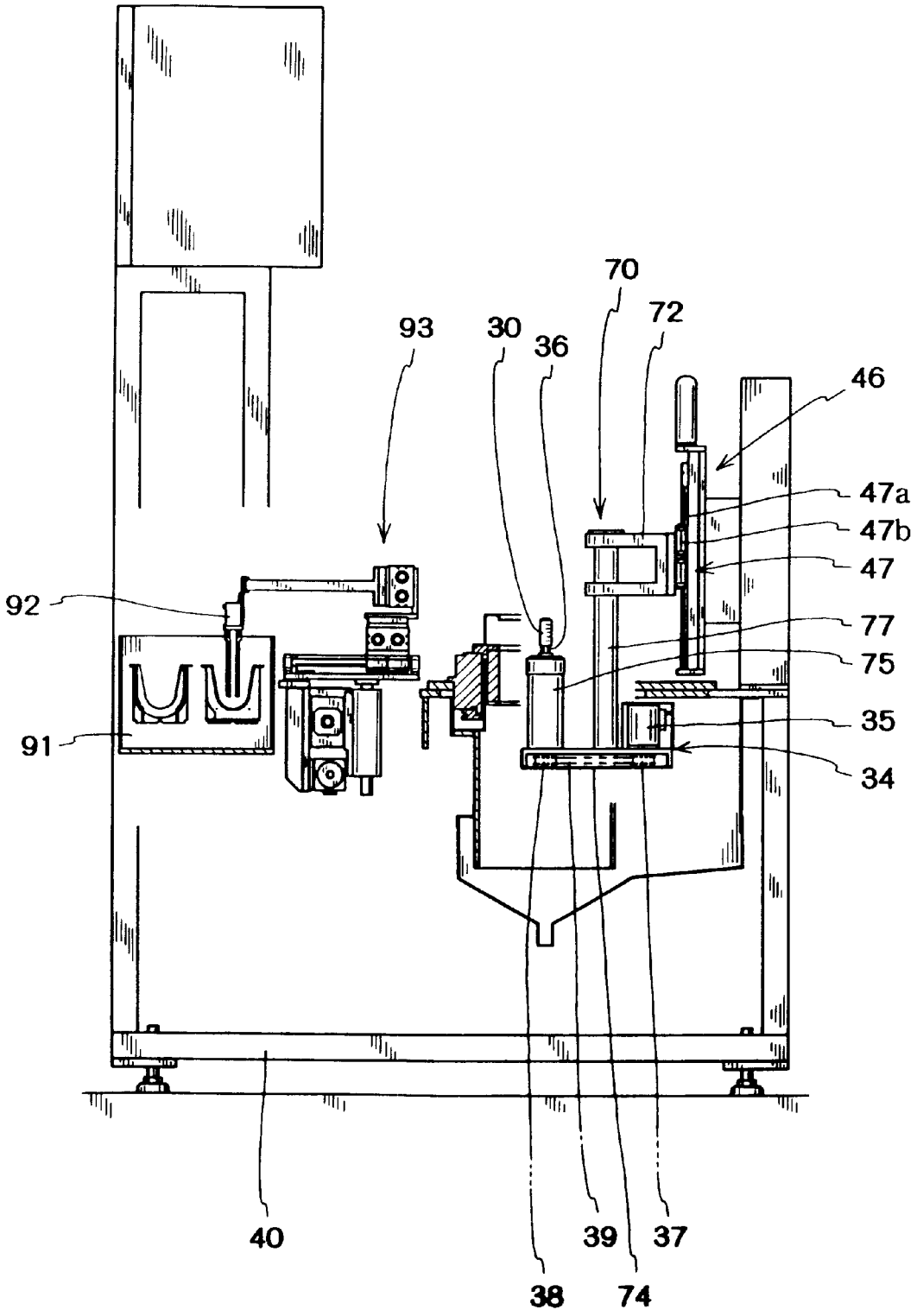
FIG. 6 is a side sectional view of a polishing machine, which polishes an inner edge of the disk, shown in FIG. 2.
Figure 7:
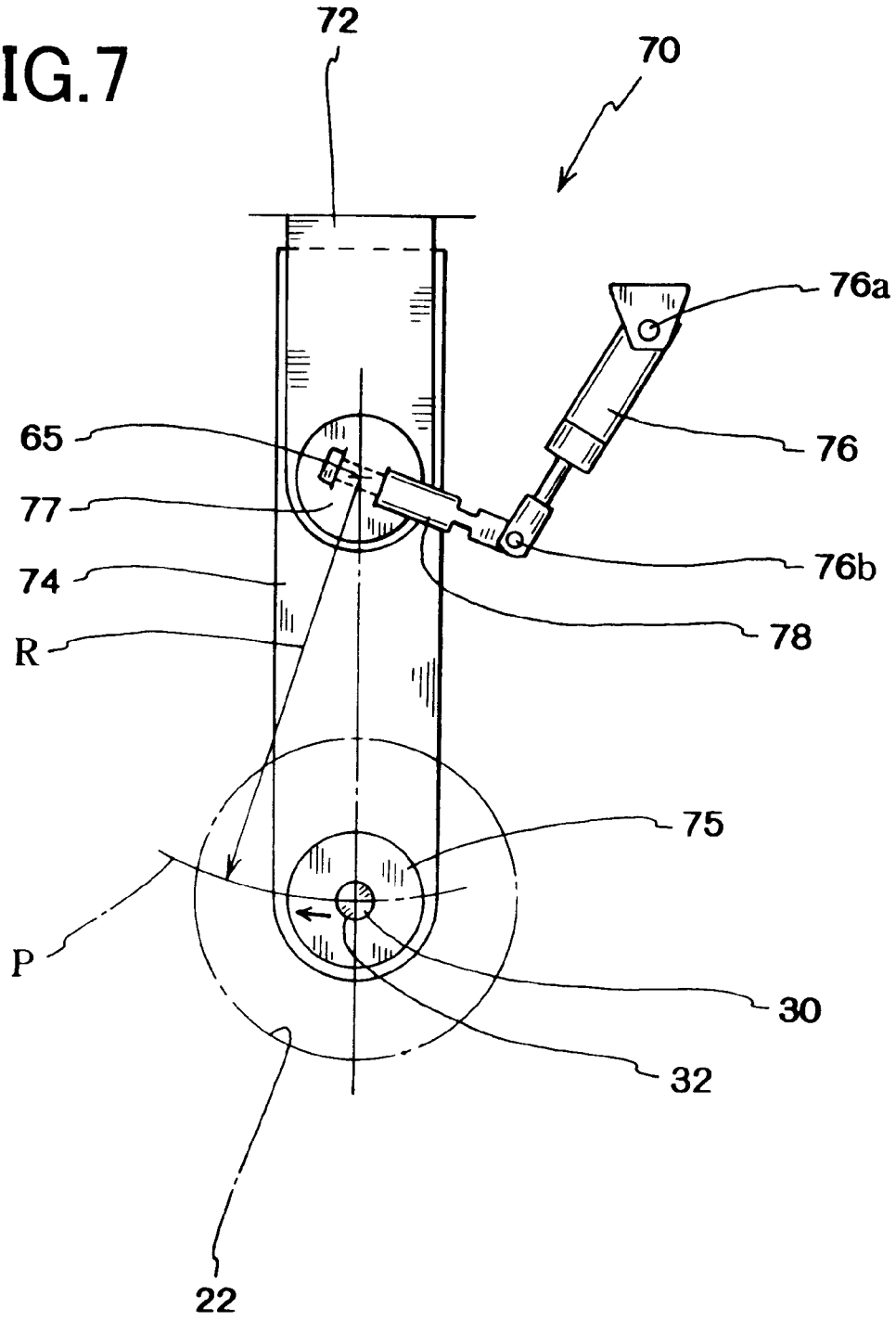
FIG. 7 is a plan view of a second driving mechanism shown in FIG. 6.

The second driving mechanism 70 moves the inner polishing member 30 close to and away from the sucking member 50 along the predetermined course "P" so as to make the outer circumferential face 32 of the inner polishing member 30 contact the inner edge 14 of the disk 10 (see FIGS. 6 and 7).

As shown in FIG. 7, the second driving mechanism 70 has a second arm 74, which is pivotatably attached to a second base section 72, and a second cylinder unit 76.

The inner polishing member 30 is rotatably attached to one end of the second arm 74. The other end of the second arm 74 is pivotably attached to the second base section 72 and can be rotated about the shaft 65. With this structure, the inner polishing member 30 can be moved along the arc course "P".

An end 76*a* of the second cylinder unit 76 is pivotably connected to the second base section 72. The other end 76*b* is pivotably connected to a front end of a second lever 78, which is fixed to a second shaft member 77. With this structure, the second cylinder unit 76 rotates the second arm 74 as a second arm driving unit.

By driving the second cylinder unit 76, the inner polishing member 30 can be moved along the arc course "P", so that the inner polishing member 30 can be moved close to and away from the inner edge 14 of the disk 10, which is held by the sucking member 50. Note that, in the present embodiment, the outer circumferential face 32 of the inner polishing member 30 can be made contact the inner edge 14 of the disk 10 by extending the second cylinder unit 76.

As described above, the elements are moved along the same arc course "P", whose center is the shaft 65, so that the course of the disk 10 for moving close to and away from the outer polishing member 20 and the course of the inner polishing member 30 for moving close to and away from the disk 10 can be easily coincided.

By coinciding the courses, the inner edge 14 and the outer edge 16 of the disk 10 can be simultaneously polished with high polishing accuracy, and the polishing efficiency can be improved.

Despite the first and the second driving mechanisms 60 and 70 have simple structures, they can drive with high accuracy. The first arm 64 and the second arm 74, which are used for polishing the edges 14 and 16 of the disk 10, are rotated about the common shaft 65, so the structures can be simplified and variation of load can be reduced. Therefore, polishing accuracy can be improved and the manufacturing cost of the machine can be reduced.

In the present embodiment, the air cylinder units 66 and 76 are employed in the first and the second driving mechanisms 60 and 70, the force for pressing the outer edge 16 of the disk 10 onto the inner circumferential face 22 of the outer polishing member 20 and the force for pressing the outer circumferential face 32 of the inner polishing member 30 onto the inner edge 14 of the disk 10 can be easily controlled, and the edges 14 and 16 of the disk 10 can be properly beveled and polished.

Figure 8:
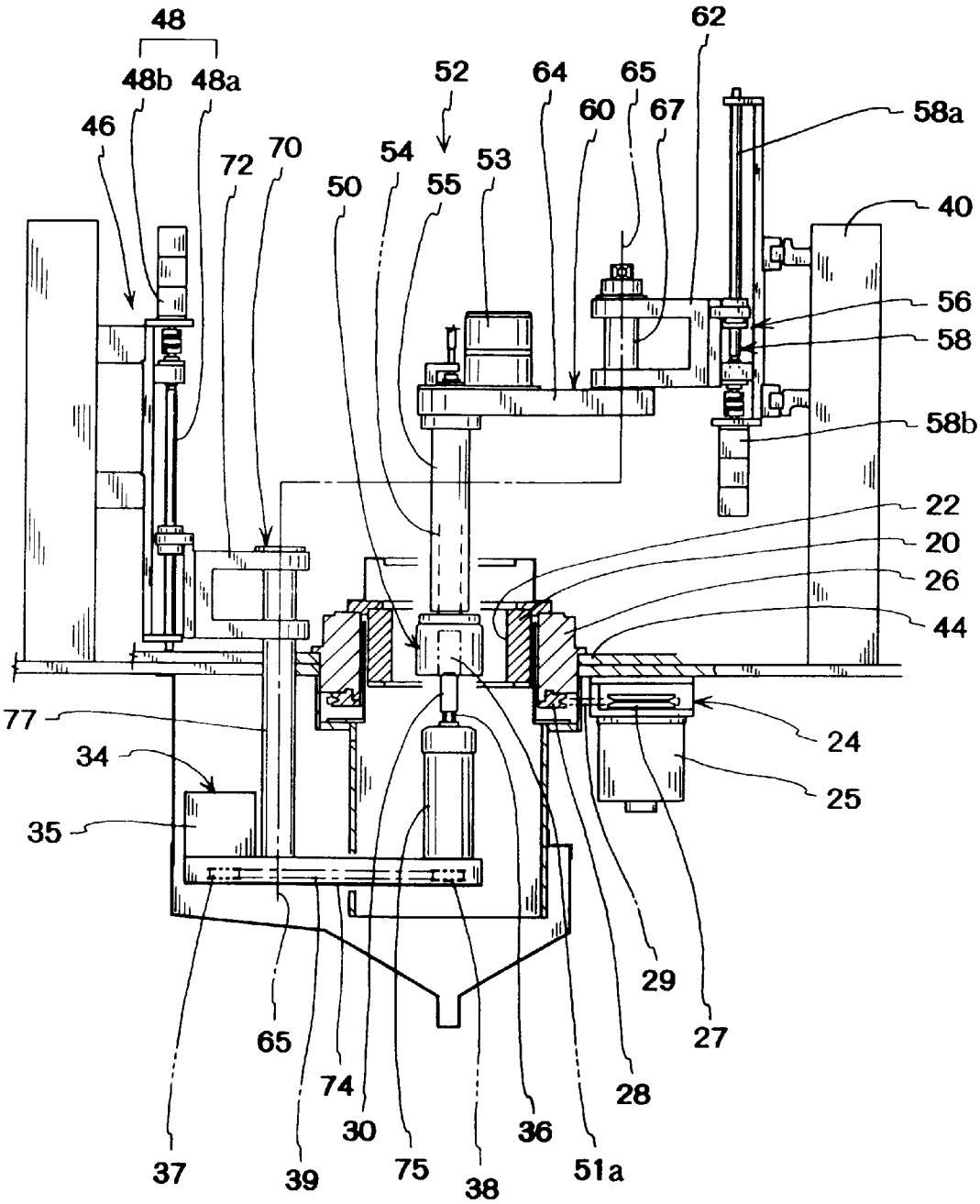
FIG. 8 is an explanation view showing a positional relationship between an outer polishing member and an inner polishing member wherein the polishing machine for polishing the inner edge is located on the opposite side, with respect to FIG. 2, so as to clearly understand.

The rotary means 24, which rotates the outer polishing member 20, comprises: an electric motor 25 being fixed to the base 40; a rotary member 26 being rotatably supported by a bearing section 44, which is provided to the base 40 and to which the outer polishing member 20 is fixed; a pulley 27 fixed to an output shaft of the motor 25; a pulley 28 being fixed to the rotary shaft 26 and coaxial to the outer polishing member 20; and a belt 29 being engaged with the pulleys 27 and 28 (see FIG. 8).

With this structure, the outer polishing member 20 can be spun about the fixed shaft 42, which is fixed to the base 40, so that the polishing work can be executed more stably.

The rotary means 34, which rotates the inner polishing member 30, comprises: an electric motor 35 being fixed to the second arm 74; a rotary member 36 being rotatably supported by a bearing section 75, which is provided to the second arm 74 and to which the inner polishing member 30 is fixed; a pulley 37 fixed to an output shaft of the motor 35; a pulley 38 being fixed to the rotary shaft 36 and coaxial to the inner polishing member 30; and a belt 39 being engaged with the pulleys 37 and 38 (see FIGS. 6 and 8).

With this structure, the inner polishing member 30 can be rotated by the rotary means 34, which is provided to the second arm 74, so that the driving force can be directly transmitted and the polishing work can be executed more stably.

In the present embodiment, the disk 10 is horizontally arranged and polished, so that the edges of the disk 10 can be uniformly polished without being badly influenced by the gravity. The shafts and the axes of spinning members are vertically arranged or extended.

Preferably, the spinning directions of the outer polishing member and the inner polishing member are opposite to the spinning direction of the disk 10, which is held by the sucking member 50. The spinning directions of the spinning members are not limited, and they may be selected on the basis of polishing conditions.

The mechanisms, which relatively horizontally move the outer. polishing member 20 and the outer polishing member 30 with respect to the disk 10, have been described above.

Successively, a mechanism, which vertically moves the disk 10 so as to make the outer edge 16 contact the inner circumferential face 22 of the outer polishing member 20, and another mechanism, which vertically moves the inner polishing member 30 so as to make the outer circumferential face 32 contact the inner edge 14 of the disk 10, will be explained. Further, a disk handling machine for feeding and receiving the disk 10 will be explained.

Firstly, the mechanism 56, which vertically moves the sucking member 50 so as to vertically move the disk 10 with respect to the outer polishing member 20, will be explained with reference to FIGS. 2–5 and 8.

As shown in FIG. 3, a linear guide rail 57*a* is vertically arranged and fixed to a horizontal base 82, which is horizontally moved by a horizontal driving mechanism 80. A slider 57*b*, which is fixed to a first base 62, is slidably attached to the linear guide rail 57*a*. With this structure, a guide mechanism 57 guides the first base 62 in the vertical direction.

As shown in FIG. 8, a ball screw 58*a* is vertically arranged and rotated by a servomotor 58*b*. With this structure, a driving unit 58 moves the first base 62 in the vertical direction. Note that, the driving unit 58 is not shown in FIG. 3, and the guide mechanism 57 is not shown in FIG. 8.

The elevating mechanism 56, which includes the guide mechanism 57 and the driving unit 58, moves the sucking member 50, in the vertical direction, with the first arm 64 and the rotary member 54. The vertical motion of the sucking member 50 is highly precisely controlled by the servo motor 58*b*.

By the elevating mechanism 56, the disk 10, which has been held by the lower end section of the sucking member 50, can be inserted into the outer polishing member 20 and level of the disk 10, with respect to the inner circumferential face 22 of the outer polishing member 20, can be optionally adjusted. Thus, level of a contact point, at which the outer edge 16 of the disk 10 contacts the inner circumferential face of the outer polishing member 20, can be periodically changed so as to use the whole inner circumferential face 22 of the outer polishing member 20. By changing the level of the contact point, the inner circumferential face 22 of the outer polishing member 20 can be uniformly abraded, so that frequency of changing the outer polishing member 20 can be lower, the polishing efficiency can be improved and the manufacturing cost can be reduced.

Next, the mechanism 46, which vertically moves the inner polishing member 30 with respect to the inner edge 14 of the disk 10, will be explained with reference to FIGS. 6–8.

As shown in FIG. 6, a linear guide rail 47*a* is vertically arranged and fixed to the base 40. A slider 47*b*, which is fixed to a second base 72, is slidably attached to the linear guide rail 54*a*. With this structure, a guide mechanism 47 guides the second base 72 in the vertical direction.

As shown in FIG. 8, a ball screw 48*a* is vertically arranged and rotated by a servo motor 48*b*. With this structure, a driving unit 48 moves the second base 72 in the vertical direction. Note that, the driving unit 48 is not shown in FIG. 6, and the guide mechanism 47 is not shown in FIG. 8.

The elevating mechanism 46, which includes the guide mechanism 47 and the driving unit 48, moves the inner polishing member 30, in the vertical direction, with the second arm 74 and the rotary member 36. The vertical motion of the inner polishing member 30 is highly precisely controlled by the servo motor 48*b*.

By the elevating mechanism 46, the inner polishing member 30, which is fixed to an upper end of the rotary member 36, can be inserted into the center hole 12 of the disk 10 and level of the inner polishing member 30, with respect to the inner edge 14 of the disk 10, can be optionally adjusted. Thus, level of a contact point, at which the inner edge 14 of the disk 10 contacts the outer circumferential face 32 of the inner polishing member 30, can be periodically changed so as to use the whole outer circumferential face 32 of the inner polishing member 30. By changing the level of the contact point, the outer circumferential face 32 of the inner polishing member 30 can be uniformly abraded, so that frequency of changing the inner polishing member 30 can be lower, the polishing efficiency can be improved and the manufacturing cost can be reduced.

Next, polishing materials of the outer and the inner polishing members will be explained.

The outer and the inner polishing members 20 and 30 of the present embodiment is mainly made of urethane foam. The urethane foam is inexpensive and can be easily exchanged. The urethane foam has a porous structure, so slurry can be kept in fine porous holes. The slurry kept in the fine porous holes can be properly supplied to portions between the polishing members 20 and 30 and the edges 14 and 16 of the disk 10, so that the polishing work can be executed properly.

A plurality of ring grooves are formed in the vertical inner circumferential face 22 of the outer polishing member 20 and they are arranged, in the axial direction of the outer polishing member 20, with regular separations. Further, a plurality of ring grooves are formed in the vertical outer circumferential face 32 of the inner polishing member 30 and they are also arranged, in the axial direction of the inner polishing member 30, with regular separations.

By forming the ring grooves, the beveled edges 14 and 16, whose sectional shapes look like tapered-shapes with tapered angles, e.g., 90° can be wholly properly polished. Namely, an upper and a lower beveled portions of the inner edge 14 and an upper and a lower beveled portions of the outer edge 16 can be securely contact the ring grooves of the outer and the inner polishing members 20 and 30, so that the beveled portions can be efficiently polished. If the polishing materials of the outer and the inner polishing members 20 and 30 have enough softness and is capable of properly contact the beveled portions of the edges of the disk 10, no ring grooves are required.

The materials and the shapes of the outer and the inner polishing member 20 and 30 may be selected on the basis of polishing conditions.

For example, in the present embodiment, the polishing members 20 and 30 are mainly made of urethane foam. But they may be mainly made of, for example, hard urethane foam including silica powders.

In the case that the polishing members are made of synthetic resin, e.g., hard urethane foam, the circumferential faces 22 and 32 of the polishing members 20 and 30 may be cut or ground so as to make new polishing faces or new ring grooves. Namely, the polishing members can be reused.

The polishing members are not limited to the urethane foam. For example, each polishing member may comprise: a base body; and polishing cloth adhered on the base body. If the polishing cloth has enough softness and can deform along the shape of the edge 14 or 16 of the disk 10 when the edge are pressed onto the polishing cloth, the polishing cloth can polish the upper and the lower beveled portions of the edge as well as the ring groove.

Next, sucking action of the sucking member 50, which is capable of holding the disk 10, will be explained with reference to FIG. 5.

The sucking member 50 includes a cylindrical sucking head 51, whose lower end if opened. The inner polishing member 30 is capable of entering an inner space Sla of the sucking head 51 (see FIG. 8).

An air inlet 59 is opened in a bottom face of the sucking head 51 and communicated to a vacuum generator 59*a* via an air path formed in the sucking head 51.

An outer V-ring 17 is fitted in an outer ring groove 51 c, which is formed in the bottom face of the sucking head 51. A lip section 17*a* of the outer V-ring 17 is exposed and its free end is headed outward.

An inner V-ring 18 is fitted in an inner ring groove 51*d*, which is formed in the bottom face of the sucking head 51 and located inside of the outer ring groove 51*c*. A lip section 18*a* of the inner V-ring 18 is exposed and its free end is headed inward.

Note that, the air inlet 59 is opened in a flat face 19 between the outer V-ring 17 and the inner V-ring 18.

Cloth 19*a* is adhered on and covers the bottom face of the sucking head 51 except the V-rings 17 and 18 so as to protect an upper surface of the disk 10. Therefore, the cloth has enough softness.

To hold the disk 10 by the sucking member 50, the V-rings 17 and 18 are tightly fitted onto the upper surface of the disk 10, then the vacuum generator 59*a* is driven. Air in a small space enclosed by the Vrings 17 and 18, the flat face 19 and the upper surface of the disk 10 is drawn via the air inlet 59, so that the space is negative pressure and the disk 10 is sucked.

The V-rings 17 and 18 are made of synthetic rubber. The V-rings 17 and 18 respectively have the lip sections 17*a* and 18*a*. By having the lip sections 17*a* and 18*a*, the V-rings 17 and 18*a* can tightly fit to the disk 10 without damaging the upper surface of the disk 10.

The sucking head 51 is made as large as possible but the outer edge 16 of the disk 10 is exposed when the sucking head 51 sucks and holds the disk 10. On the other hand, an inner diameter of the sucking head 51 is made as short as possible but the inner edge 14 of the disk 10 is exposed when the sucking head 51 sucks and holds the disk 10. With this structure, sucking area of the sucking head 51 can be broad, and the disk 10 can be held with greater sucking force.

Note that, the sucking member 50 is not limited to the embodiment. For example, other sealing members may be used instead of the V-rings.

Next, means for supplying the slurry will be explained with reference to FIGS. 1 and 5.

An outer slurry path 23 supplies the slurry from a slurry supply unit 43 to a portion, in which the outer edge 16 of the disk 10 contacts the inner circumferential face 22 of the outer polishing member 20.

An inner slurry path 33, which is communicated to an inner space of the sucking member 50, supplies the slurry from the slurry supply unit 43 to a portion, in which the outer circumferential face 32 of the inner polishing member 30 contacts the inner edge 14 of the disk 10.

With this structure, the slurry can be simultaneously supplied to the both portions, so that the both edges 14 and 16 can be polished simultaneously.

Next, the disk handling unit machine 90, which is capable of feeding the disk 10 to and receiving the disk 10 from the sucking member 50, will be explained with reference to FIGS. 2, 3 and 6.

In the present embodiment, a plurality of loading cassettes 91*a*, in which the disks 10 to be fed to the sucking member 50, and a plurality of unloading cassettes 91*b*, in which the disks 10 transferred from the sucking member 50, are soaked in pure water in a water tank 91.

A chucking unit 92 is capable of holding the disk 10. The chucking unit 92 has a pair of claws 92*a*. The claws 92*a* are inserted into the center hole 12 of the disk 10, then they are moved radially outward (opened) so as to hold the disk 10. The chucking unit 92 is moved, by a driving mechanism 93, to enter the loading cassette 91*a*, then the chucking unit 92 holds the disk 10 and conveys the disk 10 to the sucking member 50. Upon transferring the disk 10 to the sucking member 50, the chucking unit 92 receives another disk 10 from the sucking member 50 and conveys the disk 10 to the unloading cassette 91*b*. Namely, the disk handling machine 90, which feeds the disk 10 to and receives the disk 10 from the sucking member 50, comprises the chucking unit 92 and the driving mechanism 93.

Note that, the disk handling machine 90 is not limited to the present embodiment. For example, sucking means, a chucking unit having claws for catching the outer edge of the disk, etc. may be employed instead of the chucking unit 92.

The driving mechanism 93, which moves the chucking unit 92, comprises: an R-L driving unit 94 being provided to the base 40; an R-L traveler 94*a* being moved right and left by the R-L driving unit 94; a vertical driving unit 95 being provided to the R-L traveler 94*a*; an elevating member 95*a* being vertically moved by the vertical driving unit 95; a B-F driving unit 96 being provided to the elevating member 95*a*; a B-F traveler 96*a* being moved back and forth by the B-F driving unit 96; a horizontal turning unit 97 being provided to the B-F traveler 96*a*; a horizontal turning member 97*a* being turned, in a horizontal plane, by the horizontal turning unit 97; a vertical turning unit 98 being provided to the horizontal turning member 97*a*; and a vertical turning member 99 being turned, in a vertical plane, by the vertical turning unit 98.

As clearly shown in FIGS. 3 and 6, the chucking unit 92 is fixed to a front end of a horizontal arm 99*a* of the vertical turning member 99. The chucking member 92 is arranged to cross the longitudinal direction of the horizontal arm 99*a* at right angle.

By properly controlling the units of the driving mechanism 93, the chucking unit 92 can be properly moved to feed the disk 10 to and receive the disk 10 from the sucking member 50. The driving mechanism 93 is not limited to the present embodiment, a multi-joint robot arm, for example, may be used as the driving mechanism 93.

Next, an example of a horizontal driving mechanism, which horizontally moves the sucking member 50, will be explained with reference to FIGS. 2 and 3.

A linear guide rail 81*a* is horizontally fixed to the base 40. A slider 82*a*, which is fixed to a horizontal base section 82, is slidably attached to the linear guide rail 81*a*. A guide mechanism 81, which guides the horizontal base section 82 in the horizontal direction, comprises the linear guide rail 81*a* and the slider 82*a*.

As shown in FIG. 3, a cylinder unit 83 is horizontally arranged and moves the horizontal base section 82 in the horizontal direction.

The horizontal driving mechanism 80 comprises the guide mechanism 81 and the cylinder unit 83. Thus, the horizontal driving mechanism 80 is capable of reciprocally moving the sucking member 50, between a polishing stage 85, at which the edges of the disk 10 are beveled and polished, and a cleansing stage 88, with the first base 62, the first arm 64 and the rotary member 54. Note that, the sucking member 50 reaches the polishing stage 85 when the cylinder unit 83 is extended; the sucking member 50 reaches the cleansing stage 88 when the cylinder unit 83 is retracted.

Next, the cleansing stage 88 will be explained.

At the cleansing stage 88, the disk 10, which has been polished and held by the holding member 50, is cleansed by water jet. And a sucking face of the sucking member 50 is also cleansed, by the water jet, after the polished disk 10 is transferred from the sucking member 50 to the disk handling machine 90. The cleansing stage 88 includes, for example, a plurality of jet nozzles, from which water is jetted, and a collecting section for collecting the jetted water to reuse.

Note that, pressure of the water jet is, for example, 30–40 $kg/cm^2$. Of course, the water pressure may be selected on the basis of cleansing conditions.

Successively, an embodiment of the disk edge polishing system will be explained.

The embodiment of the disk edge polishing system is shown in FIG. 2. The present system includes: two polishing stages 85; one cleansing stage 88; and one disk handling machine 90.

Namely, two disk edge polishing machines, each of which has the sucking member 50, can be simultaneously operated.

In the present embodiment, centers of the two polishing stages 85 and the cleansing stage 88 are linearly arranged along a prescribed standard line, and the cleansing stage 88 is located at a center between the polishing stages 85.

The chucking unit 92 of the disk handling machine 90 is moved, by the R-L driving unit 94 of the driving mechanism 93, parallel to the standard line.

Action of the disk edge polishing system will be explained.

Firstly, as shown in FIG. 2, two sucking members 50 are respectively moved to the polishing stages 85 by the horizontal driving mechanism 80. The disk 10 is conveyed to one of the sucking members 50 by the disk handling machine 90. The disk 10 is sucked and held by the sucking member 50. After the chucking unit 92 is moved outside of the polishing stage 85, the sucking member 50 is moved downward so as to make the disk 10 enter the outer polishing member 20. Simultaneously, the inner polishing member 30 is inserted into the center hole 12 of the disk 10. In this state, the disk 10 and the inner polishing member 30 are respectively located at the initial positions, at which the disk 10 and the inner polishing member 30 are coaxially located to the outer polishing member 20. The outer polishing member 20, the disk 10 and the inner polishing member 30 are respectively rotated on their own axes.

Next, the sucking member 50, which is holding the disk 10, is moved, in the direction of an arrow shown in FIG. 4 (along the course "P"), by the first driving mechanism 60.

Simultaneously, the inner polishing member 30 is also moved, in the direction of an arrow shown in FIG. 7 (along the course "P"), by the second driving mechanism 70.

In the present embodiment, the outer edge 16 of the disk 10 comes into contact with the inner circumferential face 22 of the outer polishing member 20, so that the outer edge 16 of the disk 10 can be polished. Simultaneously, the outer circumferential face 32 of the inner polishing member 30 comes into contact with the inner edge 14 of the disk 10, so that the inner edge 14 of the disk 10 can be polished.

While the edges of the disk 10 are polished at one of the polishing stages 85, the disk handling machine 90 feeds another disk 10 to the sucking member 50 of the other polishing stage 85.

Upon completing the polishing work, the first and the second driving mechanisms 60 and 70 respectively move the disk 10 and the inner polishing member 40 to the initial positions. Then, the sucking member 50 is moved upward so as to take out the disk 10 from the outer polishing member 20. The sucking member 50, which is holding the disk 10, is horizontally moved, by the horizontal driving mechanism 80, to the cleansing stage 88, which is located between the two polishing stages 85.

At the cleansing stage 88, firstly the sucking member 50 is moved downward so as to wash the disk 10 by the water jet. Then, the sucking member 50 is moved upward and stopped at a predetermined position. The chucking unit 92 of the disk handling machine 90 is moved to receive the disk 10, and the chucking unit 92 conveys the disk 10 from the cleansing stage 88 to the unloading cassette 91*b* and accommodates therein. On the other hand, the sucking member 50, which has transferred the disk 10 to the chucking unit 92, is moved downward again to cleans its sucking face.

Then, the sucking member 50, which has been cleansed, is moved upward and moved to the polishing stage 85 by the horizontal driving mechanism 80. When the sucking member 50 reaches the polishing stage 85, one cycle of the polishing work is completed.

The polishing work of the other disk, which is held by the sucking member 50 of the other polishing stage 85, is executed late.

Polishing the disk 10 and handling the disk 10 are alternately executed at the two polishing stages 85. The two sucking members 50 alternately convey the disks 10 to the cleansing stage 88 to cleans the disks 10, etc.

Since the disk edge polishing system has the two polishing stages 85, while the disk 10 is polished at one of the polishing stages 85, the disk 10 can be fed to or taken out from the other polishing stage 85. The disks 10 can be alternately fed to and taken out the two polishing stages 85. The one disk handling machine 90 can be used efficiently. Therefore, the polishing efficiency of the system can be improved without complicating the system.

The one cleansing stage 88 can be efficiently used without complicating the system. Note that, in the present embodiment, the cleansing stage 88 employs the water jet as cleansing means, so the disks 10, etc. can be cleansed for a short time and the working efficiency can be improved.

Since two polishing stages 85 are provided, while the disk 10 is polished at one of the polishing stages 85, maintenance, e.g., exchanging the polishing member, can be executed. By providing a plurality of the polishing stages in one system, a plurality of the disks, whose sizes are different, can be polished in the system.

By linearly arranging the polishing stages 85 and the cleansing stage 88 and locating the cleansing stage 88 between the polishing stages 85, the disks 10 can be efficiently conveyed and the working efficiency can be improved.

A second embodiment of the disk edge polishing machine will be explained with reference to FIG. 9.

Figure 9:
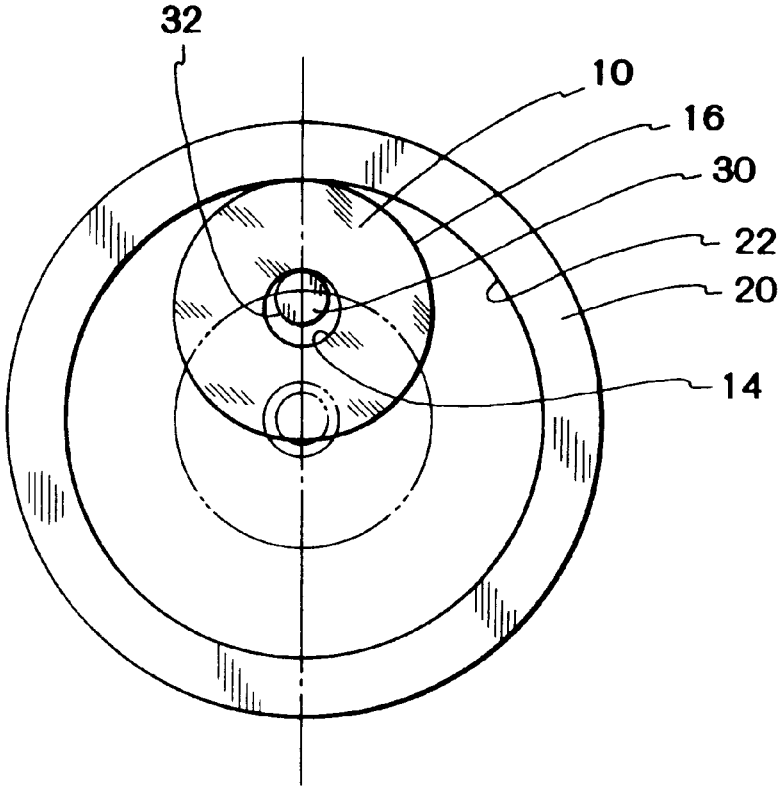
FIG. 9 is a plan view of a second embodiment of the disk edge polishing machine.

As shown in FIG. 9, the courses of the sucking member (not shown), which is driven by the first driving mechanism (not shown), and the inner polishing member 30, which is driven by the second driving mechanism (not shown), are on the same line, which is shown by one-dot chain line. Namely, in the third embodiment, the disk 10 and the inner polishing member 30 are moved from the initial positions, at which the disk 10 and the inner polishing member 30 are shown by two-dot chain lines, to the shown positions, at which the disk 10 and the inner polishing member 30 are shown by solid lines. Therefore, the first and the second driving mechanisms respectively move the sucking member and the inner polishing member 30 in the same direction. With this structure, the outer edge 16 of the disk 10 can be always moved, with respect to the inner circumferential face 22 of the outer polishing member 20, with fixed angle. And, the outer circumferential face 32 of the inner polishing member 30 can be always moved, with respect to the inner edge 14 of the disk 10, with fixed angle. Therefore, the edges 14 and 16 of the disk 10 can be polished stably.

In the case of moving the disk 10 and the inner polishing member 30 along the linear course, they can be properly moved even if they move in the opposite (180° shifted) directions. By linearly moving along the linear course, no vibration is occurred, so that the edges 14 and 16 can be simultaneously properly polished.

Figure 10:
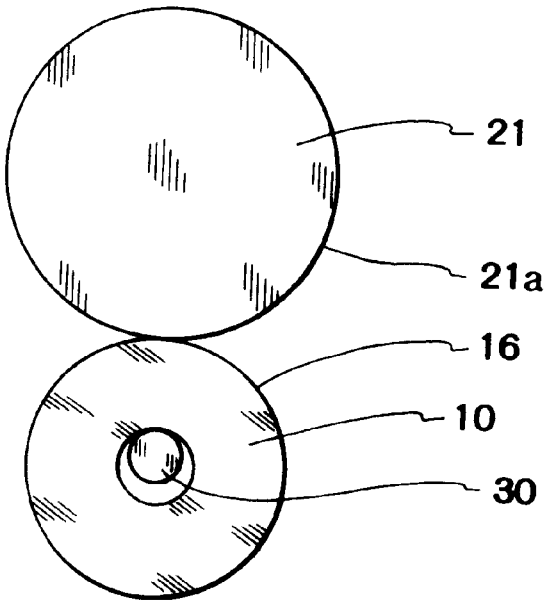
FIG. 10 is a plan view of a third embodiment of the disk edge polishing machine.

A third embodiment will be explained with reference to FIG. 10. In the third embodiment, an outer circumferential face 21*a* of an outer polishing member 21, which spins about its own axis, contacts the outer edge 16 of the disk 10, so that the outer edge 16 can be beveled and polished.

Though contact area between the outer circumferential face 21*a* of the outer polishing member 21 and the outer edge 16 of the disk 10 is not so broad, the outer polishing member 21 can be exchanged easily. To broaden the contact area, a plurality of the outer polishing members 21 may be simultaneously used.

Further, other means, which is capable of always pressing the outer edge 16 of the disk 10 with uniform force, may be employed as the outer polishing member. For example, a belt-shaped polishing member may be employed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A disk edge polishing machine, which polishes an inner edge of a center hole of a disk and an outer edge thereof, comprising:

a sucking member having a cylindrical end section, said sucking member sucking the disk by the cylindrical end section and exposing the inner edge and the outer edge of the disk, said sucking member spinning together with the disk;

an outer polishing member polishing the outer edge of the disk;

an inner polishing member being inserted into the center hole and simultaneously polishing the inner edge of the disk;

a first driving mechanism relatively moving said outer polishing member and said sucking member close to and away from the outer edge of the disk along a predetermined course; and a second driving mechanism relatively moving said inner polishing member and said sucking member close to and away from the inner edge of the disk along another predetermined course extended from the predetermined course.

2. The disk edge polishing machine according to claim 1, wherein an inner circumferential face of said outer polishing member contacts the outer edge of the disk, and said outer polishing member is spun so as to polish the outer edge of the disk.

3. The disk edge polishing machine according to claim 1, wherein said outer polishing member is spun about a fixed shaft, which is not relatively moved with respect to a base.

4. The disk edge polishing machine according to claim 1, wherein the predetermined courses are arc courses rounding a coaxial center.

5. The disk edge polishing machine according to claim 4, wherein said first driving mechanism includes:

a first arm having a first end, to which said sucking member is rotatably attached, and a second end, which is capable of pivoting about the coaxial center so as to move said sucking member on the arc course; and a first arm driving unit for turning said first arm, and said second driving mechanism includes:

a second arm having a first end, to which said inner polishing member is rotatably attached, and a second end, which is capable of pivoting about the coaxial center so as to move said inner polishing member on the arc course; and a second arm driving unit for turning said second arm.

6. The disk edge polishing machine according to claim 1, wherein the predetermined courses are linear courses.

7. The disk edge polishing machine according to claim 1, wherein said first driving mechanism and said second driving mechanism are air cylinder units.

8. The disk edge polishing machine according to claim 1, wherein said outer polishing member and said inner polishing member are mainly made of urethane foam.

9. The disk edge polishing machine according to claim 8, wherein a plurality of ring grooves are formed in the inner circumferential face of said outer polishing member and arranged, in the axial direction of said outer polishing member, with regular separations, and a plurality of ring grooves are formed in the outer circumferential face of said inner polishing member and arranged, in the axial direction of said inner polishing member, with regular separations.

10. The disk edge polishing machine according to claim 1, further comprising:

an outer slurry path supplying slurry to a portion in which said outer polishing member contacts the outer edge of the disk; and an inner slurry path being communicated to an inner space of said sucking member, said inner slurry path supplying slurry to a portion in which said inner polishing member contacts the inner edge of the disk.

11. A disk edge polishing system, comprising:

a couple of polishing stages, each of which has a disk edge polishing machine, which polishes an inner edge of a center hole of a disk and an outer edge thereof, including:

a sucking member having a cylindrical end section, said sucking member sucking the disk by the cylindrical end section and exposing the inner edge and the outer edge of the disk, said sucking member spinning together with the disk;

an outer polishing member polishing the outer edge of the disk;

an inner polishing member being inserted into the center hole and simultaneously polishing the inner edge of the disk;

a first driving mechanism relatively moving said outer polishing member and said sucking member close to and away from the outer edge of the disk along a predetermined course; and a second driving mechanism relatively moving said inner polishing member and said sucking member close to and away from the inner edge of the disk along another predetermined course extended from the predetermined course; and a disk handling machine feeding the disk to and receiving the disk from said sucking members of said polishing stages.

12. The disk edge polishing system according to claim 11, further comprising a cleansing stage being located between said polishing stages, said cleansing stage cleansing the disks, which are alternately conveyed from said polishing stages.

13. The disk edge polishing system according to claim 12, wherein centers of said polishing stages and said cleansing stage are linearly arranged along a standard line, and said cleansing stage is located at a center between said polishing stages.

14. The disk edge polishing system according to claim 13, wherein said disk handling machine has a chucking unit for holding the disk, and the chucking unit is moved, in parallel to the standard line, by a driving unit.

15. The disk edge polishing system according to claim 12, wherein said sucking members are reciprocally moved, between said polishing stages and said cleansing stage, by a reciprocating unit.

* * * * *